United States Patent [19]

Lee et al.

[11] Patent Number: 4,468,083

[45] Date of Patent: Aug. 28, 1984

[54] CRIMPED BANANA-TYPE ELECTRICAL CONNECTOR AND METHOD THEREOF

[75] Inventors: Noel Lee, Daly City; Andrew L. Choy, San Francisco, both of Calif.

[73] Assignee: Monster Cable Products, Inc., San Francisco, Calif.

[21] Appl. No.: 331,762

[22] Filed: Dec. 17, 1981

[51] Int. Cl.[3] ..... H01R 11/22

[52] U.S. Cl. ..... 339/252 P; 29/862; 339/276 T; 339/DIG. 1

[58] Field of Search ..... 29/857, 862, 863; 174/84 C; 339/252 P, 276 T, DIG. 1

[56] References Cited

U.S. PATENT DOCUMENTS

| | | | |
|---|---|---|---|
| RE. 26,208 | 5/1967 | Tupper | 29/857 |
| 1,625,125 | 4/1927 | Latour | 174/34 |
| 1,671,540 | 5/1928 | Monteil | 29/874 |
| 2,031,975 | 2/1936 | Northrup | 171/97 |
| 2,399,836 | 5/1946 | Taylor | 173/259 |
| 2,671,889 | 3/1954 | Vickery | 339/DIG. 1 |
| 2,802,257 | 8/1957 | Holtzapple | 29/863 |
| 2,959,766 | 11/1960 | Jacobsen | 339/273 |
| 3,039,076 | 6/1962 | Aymar | 339/252 P |
| 3,123,663 | 3/1964 | Muldoon | 339/276 T |
| 3,181,044 | 4/1965 | Duncan | 317/242 |
| 3,216,091 | 11/1965 | Floyd | 29/863 |
| 3,697,931 | 10/1972 | Achten | 339/95 R |
| 3,708,611 | 1/1973 | Dinger | 339/276 R |
| 3,718,750 | 2/1973 | Sayers | 339/276 R |
| 3,828,305 | 8/1974 | Hogendobler | 339/276 R |
| 4,374,458 | 2/1983 | Komada | 29/857 |
| 4,384,758 | 5/1983 | Lee et al. | 339/267 |

FOREIGN PATENT DOCUMENTS

| | | | |
|---|---|---|---|
| 064979 | 11/1946 | Denmark | 339/252 P |
| 625434 | 2/1936 | Fed. Rep. of Germany | 339/252 P |
| 227242 | 8/1943 | Fed. Rep. of Germany | 339/252 P |
| 381393 | 10/1932 | United Kingdom | 339/252 P |
| 1375854 | 11/1974 | United Kingdom | 339/252 P |

OTHER PUBLICATIONS

Ucinite Miniature Banana Pins, Ucinite Co., 04-1954, p. 1, "Electronics".

*Primary Examiner*—John McQuade
*Assistant Examiner*—Paul Austin
*Attorney, Agent, or Firm*—Warren B. Kice

[57] ABSTRACT

A crimped banana-type electrical connector includes an axially extending male pin having a conductive contact portion and a connector post extending axially from one end of the pin. The stranded or solid core of a wire or wires is positioned along the exposed post and a crimping ferrule placed over the wire and the post. The crimping ferrule is forced radially inward to crimp the wire to the post and, thereafter, an insulating sleeve is placed over the crimped connection to provide a compact and permanent mechanical and electrical connection between the wire and the banana-type pin.

2 Claims, 8 Drawing Figures

CRIMPED BANANA-TYPE ELECTRICAL CONNECTOR AND METHOD THEREOF

CROSS REFERENCE TO RELATED APPLICATIONS

The subject matter of the present application is related to that disclosed in pending U.S. patent application Ser. No. 274,767 filed June 18, 1981 by Noel Lee and Andrew L. Choy, and entitled "Electrical Connector" now U.S. Pat. No. 4,427,252 and pending U.S. patent application Ser. No. 331,764 filed Oct. 5, 1981 by Noel Lee and also entitled "Electrical Connector" now U.S. Pat. No. 4,384,758.

BACKGROUND OF THE INVENTION

The present invention relates to electrical connectors and, more particularly, to the mechanical and electrical connection between a current carrying wire and a pin type electrical connector of the banana-type.

Many types of electrical equipment including audio entertainment systems employ pin-type electrical connectors to facilitate inter-equipment connections. For example, in audio entertainment systems, including systems for use in the home and in commercial environments, the amplifiers and the loudspeakers are interconnected by a loudspeaker wire with the actual interconnection between the wires and the respective loudspeaker or amplifier effected through banana-type pin-and-socket connectors. These connectors typically include a male pin having one or more radially resilient conductor portions and a complementary post-type socket that has a smooth pin-receiving internal bore. The connection between the wire and the male pin has usually been effected through the use of a set screw, a threaded ferrule, or a directly soldered connection. In the set screw configuration, the bare wire core, either a solid or stranded core, is located in a wire-core receiving hole and then clamped in place wth an adjustable set screw which, often times, also holds an insulating ferrule in place on the pin. In the threaded ferrule configuration, the pin is provided with a wire receiving hole that extends through the body of the pin with an adjustable threaded ferrule or sleeve mounted on the pin and adjustable to place the exposed end of the wire core under shear to thereby clamp the wire to the pin. In the soldered connection configuration, the bare end of the wire is received within a wire receiving cup or bore formed in the pin and directly soldered in place. Each of these pin-to-wire connecting configurations is satisfactory although considerable time and labor can be involved in making the desired connection since these configurations are not particularly suited to automatic manufacturing techniques.

In recent years, there has been a trend in audio entertainment systems to vastly increase the power delivered to the loudspeakers. As part of this trend, it has been recognized that losses can be introduced into the system because of the traditionally used loudspeaker wire and banana-type connectors. In response to this recognition, larger diameter loudspeaker wires have been introduced and more power efficient banana-type plug configurations developed, for example, as disclosed in the above cross-referenced patent applications. The standard wire-to-pin configurations discussed above have not generally been considered satisfactory since standardized banana-type pins cannot readily accept larger diameter loudspeaker wires.

SUMMARY OF THE INVENTION

In view of the above, it is a primary object of the present invention, among others, to provide a banana-type pin connector that will readily accept connection to one or more loudspeaker wires of the type having a relatively large core size.

It is also another object of the present invention to provide a method of effecting a mechanical and electrical connection between a banana-type connector pin and a large size wire or wires in which the method is particularly suited to automatic machine-type assembly.

In accordance with these objects, and others, a male banana-type pin includes an axially extending pin portion preferably having at least one outwardly expansible conductor portion and an axially extending connecting stud. The core of a wire to be connected to the pin whether a solid or stranded core, is positioned adjacent the connecting stud and a crimp sleeve or ferrule, preferably fabricated from a malleable conductive material, is placed over the wire-wrapped stud. The ferrule is then compressed radially inward to forcibly crimp the wire core to the connecting stud. Thereafter an insulating sleeve, preferably a selected length of color-coded non-shrink or shrink-type tubing is placed over the crimped connection. When shrink-type tubing is used, the tubing is heated to provide a form-fitted insulating sleeve and strain relief.

An electrical connector in accordance with the present invention provides a connection between a current carrying wire and a banana-type pin that is both mechanically stronger and electrically more efficient than prior designs. The method by which the connection is effected between the wire core and the stud portion of the pin is amenable to both hand-type crimping and to automatic machine type assembly in contrast to prior wire-to-pin connection configurations.

BRIEF DESCRIPTION OF THE DRAWINGS

The above description as well as further objects, features, and advantages of the present invention will be more fully understood by reference to the following description of a presently preferred but nonetheless illustrative embodiment when taken in connection with the accompanying drawings wherein.

DESCRIPTION OF THE PREFERRED EMBODIMENT

Figure 1:
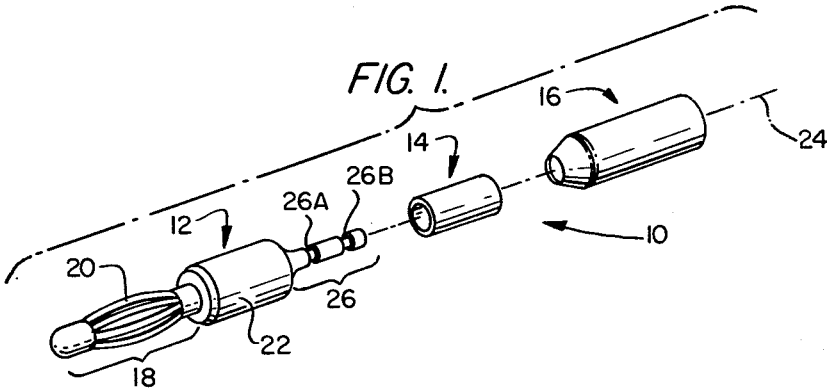
FIG. 1 is an exploded perspective view of a banana-type pin connector in accordance with the present invention.

An exemplary embodiment of a crimped banana-type connector in accordance with the present invention is shown in exploded perspective view in FIG. 1 and generally referred to therein by the reference character 10. The connector 10 includes a pin 12, a crimping ferrule 14, and a combined insulating and strain relief sleeve 16.

The pin 12 includes a forwardly extending male contact portion 18 that includes a plurality of resilient, longitudinally aligned contact leafs 20 that are designed to resiliently expand radially outward as is known in the art. In the alternative, the contact portion 18 may be formed as a solid-pin or may be formed as described in the above cross referenced patent applications. A pin base 22 is provided at the proximate end of the contact portion 18 and is formed generally as a cylindrical body about the longitudinal axis 24 of the pin 12. A reduced diameter connecting stud or post 26 extends axially rearward of the base 22. The post 26 includes a plurality of axially spaced recessed lands or grooves 26A and 26B that assist in connecting a wire core to the post 26 as explained more fully below. The crimping sleeve or ferrule 14 is preferably fabricated as a hollow tubular member fabricated from a malleable material such as a tin-plated copper or copper alloy. The combined insulating and strain relief sleeve 16 is preferably formed from a selected length of thermally responsive shrink tubing of a preferred color, thereby providing a means of color coding the electrical connector 10.

Figure 2A:
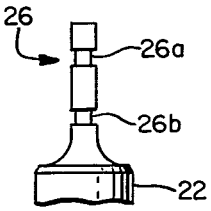
FIG. 2A is a side elevational view of the upper, post portin of the connector pin shown in FIG. 1.
Figure 2B:
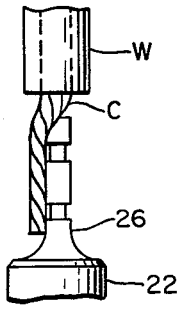
FIG. 2B is a side elevational view of the post shown in FIGS. 2A with a stranded core wire position adjacent thereto.
Figure 2C:
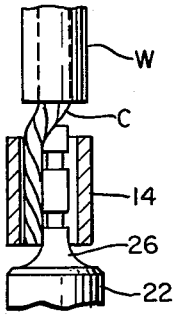
FIG. 2C is a side elevational view of the wire-wrapped post shown in FIG. 2B with a crimp sleeve positioned thereabout.
Figure 2D:
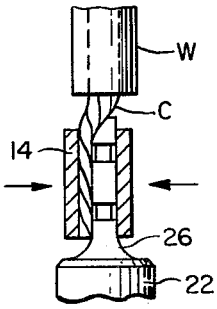
FIG. 2D is a side elevational view of the wire-wrapped post shown in FIG. 2C after the crimp sleeve has been crimped in place.
Figure 2E:
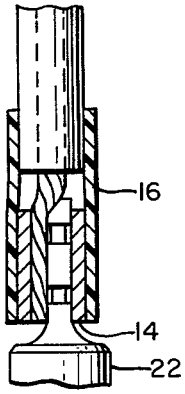
FIG. 2E is a side elevational view of the crimped wire wrapped post shown in FIG. 2D with a flexible insulating sleeve placed thereon.

The steps necessary to effect a mechanical and electrical connection to a wire W and the pin 10 are shownin FIGS. 2A–2E with FIGS. 2A illustrating the post 26 shown in FIG. 1. In FIG. 2B, the stranded non-insulated core C of a wire W is positioned adjacent the exposed stud 26. As can be appreciated, a solid core wire may be likewise connected to the exposed stud 26. In FIG. 2C, the crimping ferrule 14 is positioned over the so-wrapped stud 26 and positioned so that it extends over all or a major portion of the wrapped stud 26. Thereafter, as shown in FIG. 2D, the crimping ferrule 14 is subjected to radially inward crimping forces that force wall portions of the crimping ferrule 14 inward to effectively crimp or clamp the wire core C to the stud 26. The crimping operation may be effected by conventional hand-held crimping pliers or, more preferably, an automatic crimping machine. Subsequent to the crimping operation, as shown in FIG. 2E, the insulation strain relief sleeve 16 is positioned over the so-crimped stud 26 and subjected to thermal energy to shrink the sleeve in place as is known in the art. In the alternative, a non-shrink resilient insulating sleeve may be used.

Figure 3:
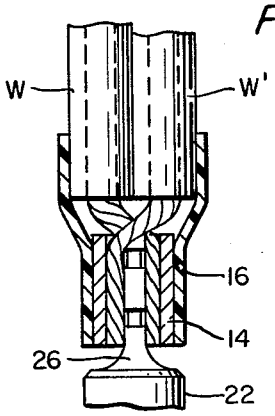
FIG. 3 illustrates, in side elevational view and partial cross section, a post portion of the pin 12 having plural current carrying wires connected thereto.

In FIGS. 2B through 2E, the pin 12 is shown having a single wire W crimped thereto. However, the present invention is readily adaptable to multi-wire connections such as those in which it is desired to connect two or more wires onto a single pin 12. This feature is shown in FIG. 3 in which a pair of wires W and W' are connected to a single stud 26 by placing the non-insulated core of each wire W and W' along side the grooved stud 26. The connection is completed in the foregoing manner with a single crimping ferrule 14 and a single insulating sleeve 16 as shown. The steps by which a plurality of wires W and W' are connected to a single stud 26 is essentially analogous to the steps necessary to connect the single wire W to the stud 26 connection shown in FIGS. 2A–2E. In connecting a plurality of wires to the stud 26, it is preferred that the wires are twisted to form a twisted pair.

Figure 4:
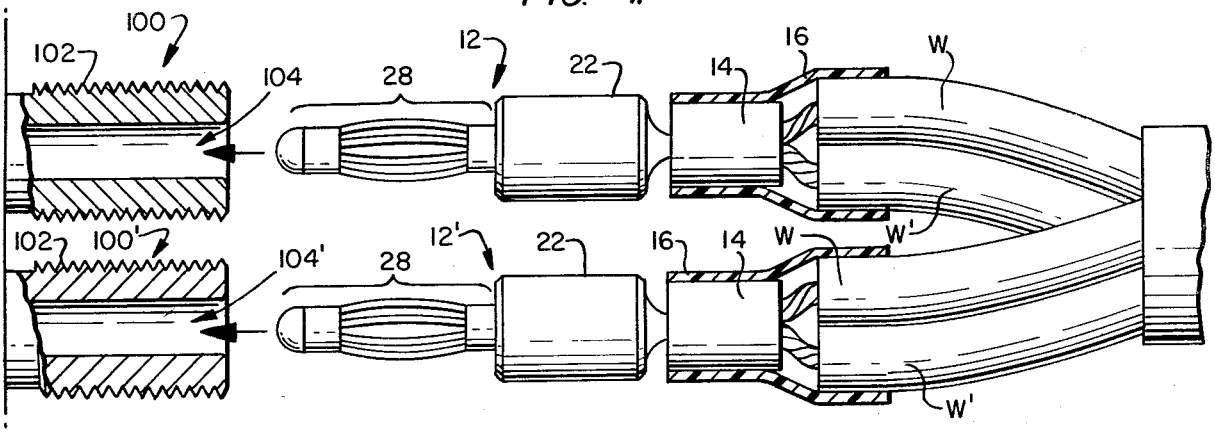
FIG. 4 illustrates a pin-type connector of the type shown in FIG. 1 having a plurality of wires connected thereto positioned adjacent a standard banana-type socket.

The electrical connector 10 can be used to effect connection between loudspeakers and/or amplifiers of conventional audio entertainment systems of the type having banana sockets 100 as shown in FIG. 4. The sockets 100 are generally provided in pairs with each socket 100 including an externally threaded post 102 having a smooth pin-receiving internal bore 104. Each pin 12 can include, for example, a pair of wires, W and W' connected thereto as illustrated in FIG. 3 and described above with the wire pairs for each electrical connector 10 twisted to form a twisted pair cable. As is known in the art, the twisted pair cable effects in cancelling the self-induction effect of the individual wires.

The electrical connector 10 in accordance with the present invention provides a connector having superior mechanical and electrical connection in the banana-type environment and provides a connector which can be manufactured by a method that is amenable to automatic machine assembly.

As can be appreciated by those skilled in the art, various changes and modifications may be made to the disclosed embodiment of the electrical connector without departing from the spirit and scope of the invention as recited in the appended claims and their legal equivalent.

What is claimed is:

1. A banana-type connector comprising:
   - a solid cylindrical base member;
   - a male pin member extending from one end of said base member and including at least one expansible conductor portion;
   - a conductor post extending from the other end of said base member and including at least one recessed groove extending transversely to the axis of said post;
   - at least one wire extending adjacent, substantially parallel to, and in contact with, said conductor post;
   - a crimped ferrule extending around said conductor post and said wire and crimped thereto to force said wire into engagement with said conductor post and into said groove; and
   - an insulating sleeve covering at least said crimped ferrule.

2. The conductor of claim 1 wherein the diameter of said conductor post is less than that of said base member.

* * * * *